343-700 MS AU 256 EX
12/9/80 OR 4,238,798

United States Patent [19]

Aitken et al.

[11] 4,238,798

[45] Dec. 9, 1980

[54] STRIPLINE ANTENNAE

[75] Inventors: James E. Aitken; Peter S. Hall; James R. James, all of Swindon, England

[73] Assignee: The Secretary of State for Defence in Her Britannic Majesty's Government of the United Kingdom of Great Gritain and Northern Ireland, London, England

[21] Appl. No.: 40,788

[22] Filed: May 21, 1979

[30] Foreign Application Priority Data

May 22, 1978 [GB] United Kingdom ..... 21195/78

[51] Int. Cl.[3] ..... H01Q 1/28

[52] U.S. Cl. ..... 343/700 MS; 343/846

[58] Field of Search ..... 343/700 MS, 846, 854

[56] References Cited

U.S. PATENT DOCUMENTS 2,411,555 11/1946 Rogers ..... 343/700 MS
3,995,277 11/1976 Olyphant, Jr. ..... 343/700 MS
4,063,245 12/1977 James et al. ..... 343/846
4,130,822 12/1978 Conroy ..... 343/700 MS

*Primary Examiner*—David K. Moore
*Attorney, Agent, or Firm*—Pollock, Vande Sande and Priddy

[57] ABSTRACT

A travelling wave stripline antenna array adapted for use as a frequency-swept antenna, comprising a pattern of conducting material on an insulating substrate with a conducting backing, the pattern comprising a feeder strip and a plurality or radiating antenna elements each in the form of a strip attached to and extending transversely away from the feeder strip, and having an open circuit termination at its free end. At least some, and preferably all, of the strips are formed with a longitudinal slot extending from the opposite side of the feeder strip and terminating before the open circuit end of the strip, so that each slotted strip behaves as a phase shifter as well as a resonant radiating antenna element.

15 Claims, 2 Drawing Figures

STRIPLINE ANTENNAE

Figure 1:
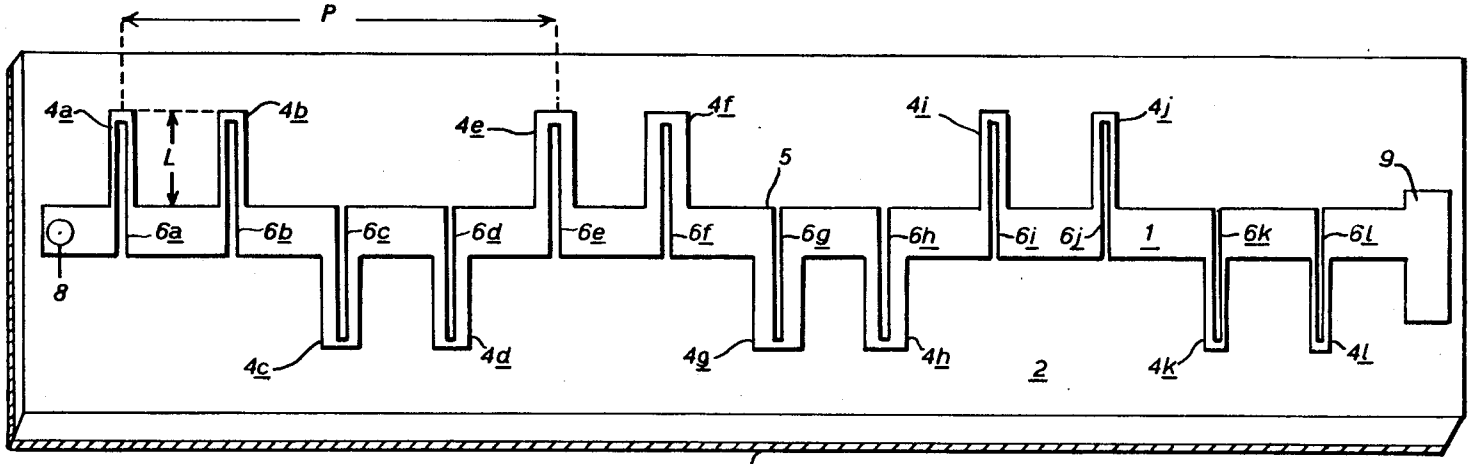

This invention relates to stripline antennae, particularly stripline antenna arrays.

James et al., U.S. Pat. No. 4,063,245 discloses a stripline antenna array comprising a pattern of conducting material on an insulating substrate with a conducting backing, in which the pattern includes a feeder strip and a plurality of array elements each comprising a strip connected at one end to and extending away from the feeder strip, the other end being an open-circuit termination. Each of the elements radiates from its termination approximately like a magnetic dipole source, and the power radiated is related to its width. Thus by suitable variation of the widths of the elements with respect to their position along the array, the antenna can be given favourable directional characteristics.

An antenna array of this kind may be designed to operate either as a standing wave or resonant array, or as a travelling wave array in which electromagnetic waves propagate along the feeder line predominantly in one sense; and antennae and antenna arrays of this latter kind can be adapted for operation as frequency-swept antennae.

A frequency-swept antenna array is one in which the direction of the main beam of the directional pattern of the array can be varied by varying the operating frequency. This is normally achieved by placing long lengths of transmission line between the elements of the travelling wave antenna array so that any change in frequency results in a relatively large change in phase shift between the elements. There are however problems associated with such arrangements in a stripline implementation, firstly in finding space to accommodate these additional lengths of transmission line, and secondly in minimizing the attenuation in them.

The foregoing James et al. patent discloses one form of stripline frequency-swept antenna array in which the feeder strip is in zig-zag sawtooth form with the element strips extending outwardly from the corners of the zig-zag. Although this configuration does provide a proportionate increase in the length of the transmission path between adjacent elements in relation to their physical separation, there is limited scope for varying the width of the strips to modify the directional characteristics of the array, and the width of the array has to be made undesirably large in order to obtain a reasonable variation in phase shift with frequency between the elements.

According to the present invention, a travelling wave stripline antenna array comprises a pattern of conducting material on an insulating substrate with a conducting backing, the pattern including a feeder strip and a plurality of elements each comprising a strip attached at one end to and extending away from the feeder strip, the other end being an open circuit termination, and at least some of the elements having a slot extending longitudinally thereof from the opposite side of the feeder strip and terminating before the open-circuit end thereof. The term stripline is intended to embrace any suitable form of strip transmission line including microstrip.

In this way, in addition to acting as a radiating element of the array, each slotted strip is also made to act as a phase shifter, the phase shift of which varies with frequency in a manner dependent upon the degree of coupling between the two sides of the strip separated by the slot. If the slot is sufficiently wide there will be little or no coupling across the slot and so the strip exhibits a linear variation in phase shift with frequency, equivalent in effect to a length of transmission line. If, however, the slot is very narrow so that there is substantial coupling between the two sides of the strip, the strip will exhibit a non-linear variation of phase shift with frequency known as the Schiffman effect, this variation being sinusoidal about the uncoupled linear phase/frequency characteristic.

Preferably substantially all the strips are slotted as aforesaid so as to provide a progressive phase difference from one end of the array to the other.

Preferably the width of the slot in each strip is such that there is substantially no coupling between the two sides of the strip across the slot. This enables a linear scan to be achieved in operation of the array as a frequency-swept array, although in some applications where, for example, non-linear scanning is required, each strip may be designed to operate as a non-linear phase shifter by reducing the width of the slot. In such applications it may also be useful to vary the widths of the slots, and thus the degree of coupling in the strips as a function of its position along the array.

Preferably each slot extends substantially the whole length of the strip to obtain maximum phase shift.

The strips may all be of the same width, although preferably they are of varying widths to provide an array having modified directional characteristics.

Preferably the strips extend at right angles from the feeder strip.

The strips may comprise a single set of strips extending from one side of the feeder strip, or two sets of strips extending from opposite sides of the feeder strip.

The or each set of strips may comprise a plurality of individual strips, or a plurality of compact groups of strips, spaced uniformly along the feeder strip.

Preferably each strip is dimensioned as a half-wave resonator (i.e. is approximately an integral number of half wavelengths long) at a predetermined operating frequency, and the individual strips, or the corresponding strips in all of the groups, in the or each set of strips are attached to the feeder strip at positions such that, in use, they resonate in phase with one another relative to electromagnetic waves propagating in the array at the same predetermined operating frequency.

Where a set of strips is provided on each side of the feeder strip, the individual strips, or the corresponding strips in adjacent groups, on opposite sides of the feeder strip are relatively positioned along the feeder strip such as to resonate half a cycle out of phase with one another.

Where the or each set of strips comprises groups of strips, the strips in each group are preferably spaced $\lambda/2n$ apart, where $\lambda$ is the wavelength of electromagnetic waves propagating in the array at the predetermined operating frequency, and n is the number of strips in each group.

A plurality of such antenna arrays may be arranged in juxtaposition to provide a two dimensional antenna array. Where the strips are arranged in groups, most energy will be radiated in a direction out of the plane of the substrate and a two dimensional array may be produced by arranging a plurality of conducting patterns as aforesaid side-by-side on a common substrate with a conducting backing.

Where the strips comprise a set of individual strips spaced uniformly apart along one side of the feeder strip, the open-circuit terminations thereof can be made to produce radiation in the plane of the substrate, in the direction in which the strips extend away from the feeder strip, by using a triplate configuration in which the conducting pattern is sandwiched between two insulating substrates each with a conducting backing, with the end terminations of the strips exposed along one edge. To permit free radiation from the strip terminations, the conducting backings of the two substrates may terminate short of this edge to leave the substrate and strip terminations protruding therefrom; or alternatively the end terminations may themselves protrude from this edge of the substrates.

A two dimensionai antenna array may then be conveniently produced by stacking the 'linear' triplate arrays.

Figure 2:
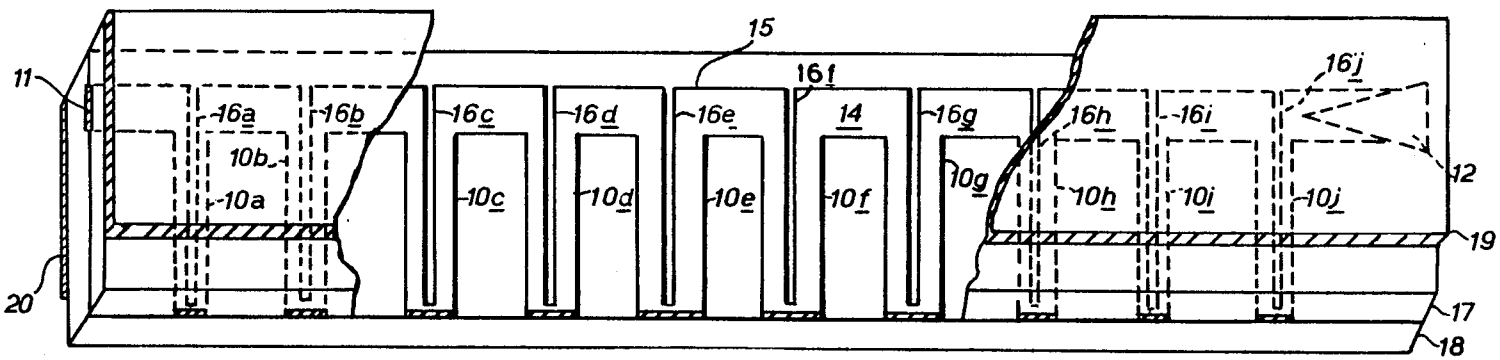

The invention will now be further described, by way of example only, with reference to the accompanying drawings, of which:

FIG. 1 shows in perspective a diagrammatic view (not to scale) of one travelling wave antenna array in accordance with the present invention; and FIG. 2 shows a part-sectional perspective diagrammatic view (not to scale) of a second travelling wave antenna array in accordance with the invention.

Referring to the drawings, the stripline antenna array shown in FIG. 1 comprises a pattern 1 of conducting material on an insulating substrate 2 with a conducting backing 3. The pattern 1 of conducting material essentially comprises a central feeder strip 5 and a plurality of short strips 4*a* to 4*l* of uniform length L each connected at one end to, and extending at right angles away from the feeder strip 5. The other end of each of the strips 4*a* to 4*l* is an open-circuit termination, which in use radiates substantially as a magnetic dipole, and the power radiated is related to its width.

The feeder strip 5 has an input/output connection 8 at one end and at the other end a reflection-inhibiting termination 9 comprising a patch resonator eccentrically connected to the other end of the feeder strip 5 so as to provide a terminating impedance matched to its characteristic impedance. Alternatively a transition into a coaxial line with a matched coaxial termination, or a triangular piece of lossy material such as resistive card overlaying the end of the feeder strip with its apex pointing inwardly, could be used to provide a wider bandwith matched termination.

In order to obtain improved directional properties, the radiation (reception) aperture of the array is 'tapered' by appropriately varying the widths of the strips with respect to their position along the array, those towards the middle of the array being thicker than those towards the ends. In practice, in order to achieve a symmetrically tapered aperture, the strips towards the termination 9 will need to be wider than those towards the input/output connection 8 to take into account attenuation and radiation losses.

The antenna array is fabricated using conventional fabrication techniques and materials such as copper for the conducting pattern 1 and backing 3, and Polyguide (Registered Trade Mark) for the insulating substrate 2.

The strips 4*a* to 4*l* are arranged in groups of two, half of them 4*a*, 4*b*, 4*e*, 4*f*, 4*i*, 4*j* being disposed along one side of the feeder strip and the other half 4*c*, 4*d*, 4*g*, 4*h*, 4*k*, 4*l* along the other side. Each of the strips 4*a* to 4*l* is formed in accordance with the invention with a slot 6*a* to 6*l* which extends longitudinally thereof from the opposite side of the feeder strip 5 and terminates just short of the open-circuit end of the strip. The width of each slot 6*a* to 6*l* is such that there is substantially no coupling between the two sides of the strip across the slot. Thus substantially all electromagnetic waves travelling along the array in use must follow a meandering path passing up and down each of the strips 6*a* to 6*l* instead of simply propagating directly along the feeder strip 5 (as in the traveling wave antenna arrays described in the abovementioned U.S. Pat. No. 4,063,245).

In optimizing the design of the antenna array, the lengths L of the strips 4*a* to 4*l* and their relative spacings are set in such a way that, at a predetermined operating frequency at which it is desired to have the main beam directed normal to the line of the array, each strip behaves as a half wave resonator; that corresponding strips in all the groups on any one side of the feeder strip resonate in phase with one another; and those on opposite sides resonate 180° out of phase with one another. Preferably also the spacing between the strips in each group is $\lambda g/2n$, where $\lambda g$ is the wavelength of electromagnetic waves in the feeder strip at the predetermined operating frequency and n is the number of elements in each group. If n is made greater than 1, i.e. the strips are arranged in groups of two or more, then this latter requirement will cause reflections from the radiation resistance of the strip terminations thrown into the feeder strip by the half-wave resonant strips, to cancel, allowing a good voltage standing wave ratio at the predetermining operating frequency.

These requirements are met in the present embodiment by setting the length L of each strip at approximately half a wavelength (in fact slightly shorter to provide an end-effect correction which is greater the wider the strip); setting the group periodic spacing P at one wavelength; and setting the spacing between any two adjacent strips, whether on the same or opposite sides of the feeder strip, at a quarter of a wavelength, all at this predetermined operating frequency.

Thus, the strips 4*a* to 4*l* each perform two functions. Firstly, they serve to couple energy from the feed strips into their open circuit terminations, (the strips being an integral number of half-wavelengths long to ensure that only the radiation resistance is transferred onto the feeder strip, i.e. no reactive loading); and secondly they behave as phase shifters having a linear frequency/-phase characteristic. In this latter role, they serve to provide a substantial increase in the propagation path length, and thus phase shift, between the radiating termination of adjacent strips resonating in phase, that is of corresponding strips in the groups on the same side of the feeder strip 5, such as strips 4*a*, 4*e*, and 4*i*. While the distance between adjacent in-phase strips, e.g. 4*a* and 4*e* along the feeder strip 5 is only one wavelength, the overall propagation path between the radiating terminations of these strips is approximately five wavelengths.

Thus, the provision of the slots 6*a* to 6*l* in the strips 4*a* to 4*l* considerably increases the amount of phase shift achievable between radiating elements for a given change in frequency while adding nothing to the overall dimensions of the array. The beam-steering effect is thus greatly enhanced.

It is not essential that each slot 6*a* to 6*l* extends the full length of the respective strip 4*a* to 4*l*; the amount of phase shift introduced by each slotted strip can be varied by varying the extent to which the slot extends into it, but for optimum performance the total propagation path between in-phase radiating end terminations should be an integral number of wavelengths long. Furthermore, all of the strips need not have slots; for example, where some of the strips are very narrow, down to 0.2 mm wide, it may be impossible to provide them with slots.

Although in the embodiment described above, the width of the slots is such that there is substantially no coupling thereacross to achieve a linear phase/frequency characteristic, the widths of the slots may be reduced or varied along the array to achieve a non-linear frequency/phase characteristic and thus a non-linear scan with frequency. This arises as a result of the Schiffman effect due to energy coupling across the slots.

The array illustrated in FIG. 1 is shown for simplicity with only twelve strips 4*a* to 4*l* providing the same number of radiating elements. However, in practice a far greater number of strips would be required, typically forty or sixty, so that as much power as possible is radiated by the elements rather than being dissipated in the end termination. It is for this reason that the strips on each side of the feeder are arranged in groups of two instead of individually, enabling a greater number of radiating elements to be provided in the same aperture size at the expense of a slight degradation in the directional properties. The array can be made even more compact by increasing the number of strips in each group, but this entails a further degradation in the directional properties.

Further reductions in the physical size of the antenna array may be achieved by using as the substrate material a dielectric having a high relative permittivity, for example, alumina, but it should be noted that for a specified beamwidth, a specified antenna aperture is required.

A two-dimensional array may be produced by arranging a plurality of conducting patterns of the above kind side by side on a common substrate and all fed from a common input/output terminal. Again to improve directionally, the widths of the strips may be varied across both dimensions of the array. As an alternative to varying the widths of the strips in the dimension transverse to the lengths of the feeder strips in such a two dimensional array, the power distribution into the individual feeder strips of the array may be varied across this dimension using a suitable splitting network (corporate feed) to achieve substantially the same effect.

FIG. 2 shows a second form of antenna array in accordance with the invention constructed in triplate configuration in which a conducting pattern 14 is sandwiched between two insulating substrates 17,18 each having a conducting backing 19,20. The conducting pattern comprises a feeder strip 15 having an input/output connection 11 at one end, an impedance matched termination 12 comprising a triangular piece of resistive card overlying the other end, and a set of individual uniformly spaced strips 10*a* to 10*j* connected to, and extending at right angles away from the feeder strip 15. The free ends of the strips 10*a* to 10*j* are open-circuit terminations each terminating along one edge of the two substrates. Along this edge the conducting backing 19,20 of each substrate 17,18 is cut-back to enable the strip terminations to radiate more freely.

To improve directional characteristics, the widths of the strips 10*a* to 10*j* vary along the length of the array, and, in accordance with the invention each strip has a respective longitudinal slot 16*a* to 16*j* extending from the opposite side of the feeder strip 15 and terminating short of the free end of the strip. The width of each slot is such that substantially no coupling occurs between the two sides of the associated strip across the slot, so that each strip behaves as a linear phase shifter as described above in connection with FIG. 1.

Each strip is designed to behave also as a half-wave resonator, and this is achieved by making it approximately an integral number of half-wavelengths long relative to waves propagating in the strip at a predetermined operating frequency. The strips 10*a* to 10*j* are also spaced apart along the feeder strip 15 at intervals of one wavelength at the same frequency so that they all resonate in phase at this frequency. The main beam of the antenna array will then be normal to the line of the array in the plane of the substrate and in the direction in which the strips 10*a* to 10*j* extend away from the feeder strip 15.

However, in addition to acting as a resonator, each strip also acts as a phase shifter, effectively increasing the propagation path length between radiating elements of the array due to the presence of the slots. In the absence of the slots, the effective propagation distance between adjacent radiating elements is the inter-strip spacing, i.e. one wavelength, while the presence of the slots increases this by twice the length of each strip, as the slots extend substantially the full length of each strip. Thus the longer each strip is made, the greater will be the phase shift introduced by it and the greater will be the beam steering effect. Thus, if each strip is made one wavelength long, it will not only resonate as a half-wave resonator but it will also provide a propagation path of three wavelengths between adjacent radiating elements.

In order to produce a two-dimensional antenna array, a plurality of linear antenna array of this kind may be stacked with their strips all facing the same direction, so that their radiating end terminations all lie in a common plane. To provide improved directional properties in two planes, the widths of the strips may be varied across both dimensions of the array, or the power distribution to the feeder strips may be varied as described above, to achieve the same effect in the dimension transverse to the feeder strips 15.

It will be appreciated that the described embodiments may be modified in many ways without departing from the scope of the invention. The invention could be applied to antennae for use at any frequency in the radio frequency range, including millimeter and submillimeter wave frequencies, subject to the availability of suitable technology. Antennae in accordance with the invention can be made on any suitable substrate material, those with higher dielectric constants, such as alumina and quartz, due to the type of technology used (i.e. evaporation instead of etching) could improve antenna definition and hence performance control. The slots need not extend to the tips of the strips, but may readily be made to terminate at any convenient point along the strip at the expense of a reduction in the phase shift achieved. It is not essential that no coupling occurs across the slots, in some cases such coupling may be found to be desirable to take advantage of the Schiffman effect. Although largely described in terms of their transmission characteristics, the described embodiments, and any antenna arrays in accordance with the invention may equally be used for reception as will be apparent to persons skilled in the art.

What I claim is:

1. A traveling wave stripline antenna array comprising a pattern of conducting material on an insulating substrate with a conducting backing, the pattern including an elongated feeder strip and a plurality of antenna elements disposed in spaced relation to one another along the feeder strip and each comprising an elongated strip of conducting material connected at one of its ends to and extending away from an edge of the feeder strip, the other end of each of said strips being an open-circuit termination, the feeder strip being interrupted at each of said antenna elements by a slot extending longitudinally of the element from the edge of the feeder strip opposite to that to which it is connected and terminating within the antenna element before the open circuit end thereof.

2. An antenna array as claimed in claim 1 wherein each antenna element is dimensioned as a half-wave resonator at a predetermined operating frequency, and the antenna elements extending from one edge of the feeder strip comprise a set of individual antenna elements spaced along the feeder strip at positions such that, in use, the individual antenna elements of the set resonate in phase with one another relative to electromagnetic waves propagating in the array substantially at said predetermined operating frequency.

3. An antenna array as claimed in claim 1 wherein each antenna element is dimensioned as a half-wave resonator at a predetermined operating frequency, the antenna elements being disposed in respective sets on opposite sides of the feeder strip, and the individual antenna elements in each set are spaced along the feeder strip at positions such that, in use, the individual antenna elements in each set resonate in phase with one another, and those in one set resonate half a cycle out of phase with those in the other set, relative to electromagnetic waves propagating in the antenna array substantially at said predetermined operating frequency.

4. An antenna array as claimed in claim 2 wherein the individual antenna elements of said set are spaced uniformly apart along one side of the feeder strip, the conducting pattern being sandwiched between said insulating substrate with a conducting backing and a second insulating substrate having a conducting backing on its outwardly facing major surface, and wherein the open circuit terminations of each of said antenna elements is exposed along a common edge of the two substrates.

5. An antenna array as claimed in claim 4, wherein the conducting backings of the two substrates terminate short of said common edge of the two substrates.

6. A two-dimensional antenna array comprising a plurality of antenna arrays as claimed in claim 5 stacked such that the open circuit terminations of the antenna elements of each array lie substantially in a common plane.

7. A two-dimensional array as claimed in claim 6, wherein the widths of the antenna elements of the array vary as a function of their position in a direction transverse to the feeder strips, to provide modified directional characteristics in a plane transverse to the feeder strips.

8. An antenna array as claimed in claim 1 wherein each antenna element is dimensioned as a half-wave resonator at a predetermined operating frequency, and the antenna elements extending from one side of the feeder strip comprise a set, said set comprising a plurality of compact groups of antenna elements spaced along the feeder strip at positions such that, in use, the corresponding antenna elements in all of the groups in the set resonate in phase with one another relative to electromagnetic waves propagating in the array at substantially the same predetermined operating frequency.

9. An antenna array as claimed in claim 8 wherein the antenna elements are disposed in a first set of compact and separate groups of elements extending from one side of the feeder strip at positions such that the corresponding antenna elements in all groups of the first set are in phase with one another relative to electromagnetic waves propagating in the array substantially at said predetermined operating frequency, and a second set of similar groups of antenna elements extending from the opposite side of the feeder strip in the opposite direction to the elements of the groups of the first set, and attached to the feeder strip at positions such that corresponding antenna elements in all the groups of the second set are in phase with one another, but half a cycle out of phase with corresponding antenna elements in the groups of the first set relative to electromagnetic waves propagating in the array substantially at said predetermined operating frequency.

10. An antenna array as claimed in claim 8, wherein, the antenna elements in each group are spaced $\lambda/2n$ apart, where $\lambda$ is the wavelength at which electromagnetic waves propagate in the array at the predetermined operating frequency, and n is the number of antenna elements in each group.

11. A two-dimensional antenna array comprising a plurality of antenna arrays as claimed in any one of claims 8 to 10 arranged side-by-side on a common substrate and fed from a common input/output terminal.

12. A two-dimensional antenna array as claimed in claim 11, wherein the antenna elements on each feeder strip are of various different widths to provide the array with modified directional characteristics in a plane parallel to the feeder strips and normal to the plane of the array.

13. A two-dimensional antenna array as claimed in claim 12, including corporate feed means on said common substrate arranged to distribute power applied to the input-output terminal between the feeder strips of the array such that the power applied to the individual feeder strips varies across the array in a direction traverse to the feeder strips to provide the array with modified directional characteristics in a plane transverse to the feeder strips.

14. An antenna array as claimed in any one of claims 1 to 10 wherein the antenna elements are of various different widths to provide the array with modified directional characteristics.

15. An antenna array as claimed in claim 1 wherein the width of the slot in each antenna element is such that there is substantially no coupling across the slot between the two portions of the antenna element on opposite sides of the slot.

* * * * *